US012571396B2

(12) United States Patent
Jimenez

(10) Patent No.: US 12,571,396 B2
(45) Date of Patent: Mar. 10, 2026

(54) IMPELLER PUMP APPARATUS FOR PUMPING SHEAR SENSITIVE FLUIDS

(71) Applicant: MXQ, LLC, Houston, TX (US)

(72) Inventor: Juan Jimenez, Houston, TX (US)

( * ) Notice: Subject to any disclaimer, the term of this patent is extended or adjusted under 35 U.S.C. 154(b) by 0 days.

(21) Appl. No.: 18/675,885

(22) Filed: May 28, 2024

(65) Prior Publication Data

US 2025/0369445 A1 Dec. 4, 2025

(51) Int. Cl.
*F04D 5/00* (2006.01)
*F04D 29/22* (2006.01)
*F04D 29/24* (2006.01)

(52) U.S. Cl.
CPC ..... *F04D 5/001* (2013.01); *F04D 29/2255* (2013.01); *F04D 29/242* (2013.01)

(58) Field of Classification Search
CPC .... F04D 5/001; F04D 29/2216; F04D 29/225; F04D 29/68; F04D 17/161; F04D 31/00; F04D 7/04
See application file for complete search history.

(56) References Cited

U.S. PATENT DOCUMENTS 1,013,248 A * 1/1912 Wilkerson ..... F04D 19/04 366/264
4,527,947 A * 7/1985 Elliott ..... F04D 7/045 415/121.2
4,773,819 A 9/1988 Gurth
4,940,385 A * 7/1990 Gurth ..... F04D 5/001 415/206
5,355,993 A 10/1994 Hay
5,381,886 A * 1/1995 Hay ..... F04D 17/161 406/99
5,385,443 A 1/1995 Dufour
5,551,553 A 9/1996 Hay
7,044,288 B2 5/2006 Barer
7,695,242 B2 * 4/2010 Fuller ..... F03D 3/0409 416/185
8,210,816 B2 7/2012 Geldenhuys
9,605,663 B2 * 3/2017 Irvin, Sr. ..... B01D 45/12
11,512,708 B1 * 11/2022 Chen ..... F04D 29/281
11,680,578 B1 * 6/2023 Jimenez ..... F04D 29/2216 416/223 B
2005/0231916 A1 * 10/2005 Bahl ..... H01L 23/427 257/E23.099
2007/0258824 A1 11/2007 Pacello
(Continued)

FOREIGN PATENT DOCUMENTS

CN 112833029 A * 5/2021
WO 2014073976 A1 5/2014

*Primary Examiner* — Courtney D Heinle
*Assistant Examiner* — Ryan C Clark
(74) *Attorney, Agent, or Firm* — EGBERT, MCDANIEL & SWARTZ, PLLC

(57) ABSTRACT

An impeller for a disc pump has a drive disc having a connector adapted to join with a shaft of the disc pump, and a driven disc affixed to the drive disc so as to define a space therebetween. The drive disc has a face facing a face of the driven disc. The drive disc extends in generally parallel relationship to the driven disc. At least one of the faces of the drive disc and the driven disc has an undulating surface thereon. A plurality of posts are affixed to the face of the drive disc and the driven disc. Each of these posts has an airfoil-shaped cross-section in a plane parallel to the face of the drive disc and the driven disc.

7 Claims, 4 Drawing Sheets

(56) References Cited

U.S. PATENT DOCUMENTS

| | | | | |
|---|---|---|---|---|
| 2008/0213093 | A1 | 9/2008 | Guelich | |
| 2012/0014779 | A1 | 1/2012 | Gillim | |
| 2014/0070541 | A1* | 3/2014 | Irvin, Sr. | F04D 5/00 290/52 |
| 2015/0308446 | A1 | 10/2015 | Koivikko | |
| 2018/0003163 | A1* | 1/2018 | Irvin, Sr. | B04B 1/04 |

* cited by examiner

IMPELLER PUMP APPARATUS FOR PUMPING SHEAR SENSITIVE FLUIDS

CROSS-REFERENCE TO RELATED APPLICATIONS

Not applicable.

BACKGROUND OF THE INVENTION

The present invention relates to disc pumps. More particularly, the present invention relates to the impellers for moving fluids associated with such disc pumps. More particularly, the present invention the relates to the surfaces of the faces of the discs of the impeller and to the posts that connect the drive disc to the driven disc of the impeller.

Traditional centrifugal pumps have vanes which are designed to shear and sling the liquid in order to impart a centrifugal force. These typical centrifugal pumps have problems with cavitation, clogging, binding, and high wear when used for pumping slurries, liquids with solids, high viscosity liquids and liquids with entrained air or gas. Because of these shortcomings, centrifugal pumps are available with modified impellers which have no vanes or have fractional vanes to avoid complete impingement on the liquid. These are known as "disc pumps". Disc pumps are commonly chosen to transport liquids with slurries with solids, liquids of high viscosities, and liquids having entrained air or gas.

As will be described hereinafter, a disc pump is comprised of an outer housing with an inner cylindrical rotor chamber having an inlet at one end and an outlet at the outer periphery. A rotor assembly in the chamber is comprised of at least two parallel spaced discs disposed co-axially in the chamber and connected together for rotation about a center axis. The inner opposing faces of the disc are spaced a predetermined distance apart in a series of raised ribs or vanes that are provided on at least one of the opposing faces. The vane height is less than the disc spacing. A first disc is known as the "drive disc" and is attached to the pump shaft. The other discs are attached to the drive disc via pins or posts and are known as "driven discs". The drive disc is solid. The additional discs have a hole in a center to allow liquid to enter.

The inherent design of a disc pump removes typical vanes from the impeller and uses fractional drag or surface tension to propel the liquid. Some disc pumps have incorporated rectangular ribs to make the discs more efficient. These ribs start at the center of the disc and extend to the outside diameter of the disc. The rectangular ribs have edges that shear the sensitive fluids and cause turbulence.

Boundary layer or bladeless turbines, pumps, and other related turbo-machinery have been known for one hundred years or more. Nikola Tesla obtained a patent (U.S. Pat. No. 1,061,142) for such a device in 1913. The Tesla patent disclosed a multiple-disc pump that utilized rotating flat discs with no blades, vanes, or propellers. Such pumps have been referred to as disc pumps, boundary layer pumps, or bladeless pumps.

In U.S. Pat. No. 1,061,206, Tesla disclosed a fluid-driven boundary layer or bladeless turbine which may be utilized as a prime mover in various applications. The Tesla bladeless turbine, when used as the driving force for a hydro-electric generator, could transform the kinetic energy of a flowing fluid into electrical energy. In U.S. Pat. No. 1,329,559, Tesla disclosed another application of the bladeless turbine, this time in an internal combustion engine. The Tesla patent show early disclosures of rotational machines using bladeless or boundary layer discs.

Unlike more traditional centrifugal pumps which utilize vanes, blades, augers, buckets, pistons, gears, diaphragms, and the like, boundary layer pumps, such as those described by Tesla, typically utilize multiple rotating parallel discs. Disc pumps, as these machines are sometimes called, utilize the fluid properties of adhesion and viscosity. These fluid properties combine to create an interaction between the fluid and the rotating flat discs that allow the transfer of mechanical energy from the rotating discs to the fluid.

Boundary layer or disc pumps (both names are used in the industry and both are used interchangeably) have been reported to have advantages over traditional pumps, especially when utilized for pumping fluids other than cool, clean, homogenous liquids. The vanes, buckets, or the like, of traditional pumps wear and lose effectiveness due to normal friction and/or impingement with particles (such as sand or other abrasives). However, the flat surfaces of boundary layer pumps are much less susceptible to wear. It is not unusual for such a pump to show little or no wear even after extended use.

Disc pumps have been found to be especially effective for pumping high-viscosity fluids wherein the a efficiency of such pumps may actually increase as the fluid viscosity increases. Disc pumps have also been reported to be more cost-effective in terms of reliability and decreased downtime for pumping problematic multiphase fluids, which may comprise gases, liquids, and/or solid materials. Disc pumps have been found to greatly reduce maintenance costs and downtime when used to replace more traditional pumps in these demanding settings.

Traditional centrifugal pumps have vanes which are designed to shear and sling the liquid in order to impart centrifugal force. These typical centrifugal pumps have problems with cavitation, clogging, binding, and high wear when used for pumping slurries, liquids with solids, high viscosity fluids, and fluids with entrained air or gas. Because of the shortcomings, centrifugal pumps are available with modified impellers which have no vanes or have fractional vanes to avoid complete impingement on the liquid. These are also known as disc pumps. Disc pumps are commonly chosen to transport liquids with slurries having a great amount of solids, a high viscosity, and slurries with entrained air or gas. They are also used to pumps the shear-sensitive liquids and to prevent emulsification or degradation of the liquid.

The inherent design of a disc pump removes typical vanes from the impeller and uses friction drag or surface tension to propel the liquid. This design creates slippage and is very inefficient. Some disc pump designs have incorporated rectangular ribs to make the discs more efficient. These ribs start at the center of the disc and extend to the outer diameter of the disc. Despite these modifications, these improvements are still highly inefficient because of dead zones created by vortices on the back of the rectangular ribs and lack of surface area to propel the liquid in a laminar manner.

FIGS. 1-3 show a particular structure of the rotary disc pump. FIGS. 1-3 are described in U.S. Pat. No. 4,940,385, issued on Jul. 10, 1990 to M. I. Gurth. FIGS. 1 and 2 illustrate a rotary disc pump 10 for pumping various types of fluids, including relatively abrasive slurries or fluids having solid contents, highly viscous fluids, and fluids having entrained gas contact. The pump basically comprises a housing 12 having an inner cylindrical rotor chamber 14 in which a rotor assembly 16 for pumping fluid through the pump is rotatably mounted. Chamber 14 has an inlet 18 at one end and an outlet 20 extending generally tangentially from the outer periphery of the chamber.

The rotor assembly 16 is illustrated in FIGS. 2 and 3 and comprises a pair of parallel, spaced discs 22, 24 disposed coaxially in the rotor chamber 14. The first disc 22 at the inlet of the chamber has a central opening 26 aligned with inlet 18 for allowing fluid to flow from the inlet into the spacing between the discs. The first disc is connected to the second or drive disc 24 via a plurality of pins or connectors 28 spaced around and closely adjacent to the axis of the discs. The drive disc 24 is connected on its outer face 30 to a suitable driveshaft 32, which is connected to a motor (not shown) for driving the assembly.

Each disc 22, 24 has a plurality of generally radially extending vanes or ribs 34, 35 on each of its faces, which extend from the outer periphery of the disc towards the center. The ribs 34, 35 have bars of generally rectangular cross-section welded to the opposite faces of each disc. Eight vanes are provided on each disc face at equal intervals. The vanes 34, 35 on the opposing disc faces are in alignment, as shown in FIG. 3. The discs 22, 24 are spaced a predetermined distance apart, depending on the characteristics of the fluid to be pumped. The combined height of the opposing vanes on the interfaces of the discs is less than the disc spacing so as to leave a large gap between the opposing inner vanes (as shown in FIG. 2). This gap depends on the characteristics of the fluid being pumped. The vanes or ribs are straight and of uniform width. The vanes extend up to or close to the center opening 26 in disc 22 and are of equivalent or slightly greater length on disc 24. The inner ends 38 of the vanes are pointed or tapered as illustrated to provide more clearance for fluid to pass between the vanes where they converge together towards the center of each disc.

In operation, fluid enters the pump through the inlet conduit and proceeds to the spacing between the opposing disc faces. As the discs rotate, the fluid will proceed radially outwardly to the outer portions of the disc by a combination of friction and pressure gradients, along with viscous drag created by the rotating discs enhanced by the action of the vanes. This adds to the profile or form passing through the fluid and thus increases the form drag. The fluid is then discharged through the outlet which is located on an area of the peripheral wall of the chamber between the two discs.

In the past, various patents and patent application publications have issued with respect to such centrifugal or disc pumps. For example, U.S. Pat. No. 1,013,248, issued on Jan. 2, 1912, describes a centrifugal pump which is the combination of a pump casing, a rotatable shaft mounted therein, and a series of friction or impeller discs carried by the shaft. Curved vanes are secured between the impeller discs near the periphery thereof. The vanes overlap each other, but leave a gradually narrowing space from the center outwardly. The impeller discs have interior rounded edges and a means for fastening the impeller structure together.

U.S. Pat. No. 4,773,819, issued on Sep. 27, 1988 to M. I. Gurth, describes a rotary disc slurry pump that includes a rotary pump having a plain disc impeller disposed in a cylindrical chamber of a housing with an inlet coaxial of the impeller into the housing and a substantially square outlet from the periphery of the chamber. A rotor is arranged to provide a substantially unobstructed passage between the inlet and the outlet of the pump.

U.S. Pat. No. 5,355,993, issued on Oct. 18, 1994 to A. G. Hay, teaches an apparatus for transporting and metering particulate material. This apparatus includes a transport duct having an inlet, an outlet, and at least one moving surface located therebetween and having a downstream facing drive surface. A motive device for moving the moving surface between the inlet and the outlet is provided. The particulate matter is compacted sufficiently to cause the formation of a bridge composed of substantially interlocking particulates spanning the width of the transport duct. The bridging of the particulates causes the particulates to become semi-hydrostatic in nature such that the force exerted by the downstream facing drive surface upon the particulates within the transport duct drives the entire mass of material through the transport duct toward the outlet.

U.S. Pat. No. 5,385,443, issued on Jan. 31, 1995 to R. Dufour, shows a centrifugal liquid pump of the rotary disc type that incorporates a gas injection assembly. The gas injection assembly allows up to 15% per volume of the gas to be mixed with the pumped liquid. The gas injection is achieved with a gas feed pipe that enters the pump to its axial inlet with a plurality of gas injectors that project from the gas feed pipe radially within the impeller.

U.S. Pat. No. 5,551,553, issued on Sep. 3, 1996 to A. G. Hay, discloses an apparatus for transporting particulate material. A housing is provided and includes a wall defining an inlet and a wall defining an outlet space downstream from the outlet. A duct is enclosed in the housing between the inlet and the outlet. The duct is formed between first and second substantially opposed drive walls movable relative to the housing from the inlet toward the outlet and at least one arcuate wall extending between the inlet and the outlet. The drive walls have a greater surface area for contacting the solid material than the arcuate walls. The drive walls rotate relative to an axis. An assembly is provided for positioning the second drive wall in the housing for rotation in a plane at an angle relative to the axis such that the distance between the first and second drive walls adjacent to the inlet is greater than the distance downstream from the inlet when the drive walls are moving.

U.S. Pat. No. 7,044,288, issued on May 16, 2006 to Baer et al., shows a bulk material pump having a housing and a rotatable drive rotor for transporting material from an inlet to an outlet of the housing. The drive rotor has a hub. Drive discs extend away from the hub toward an inner wall of a housing. The distance between the circumferential edges of the drive discs and the inner wall of the housing increases from the inlet to the outlet in the direction of rotation of the drive rotor. A low-friction brush seal is disposed on the periphery of the drive discs so as to seal the area between the periphery of the drive discs and the inner wall. A material scraper having a flexible tip is mounted in the housing and extends into the drive rotor between the drive discs.

U.S. Pat. No. 8,210,816, issued on Jul. 3, 2012 to S. Geldenhuys, teaches an impeller for a centrifugal pump. The centrifugal pump includes a pump casing within which an impeller is mounted for rotation, in a cantilever fashion, on a shaft. The casing has an axial inlet and a peripheral volute around the impeller leading to an outlet. The impeller has axially spaced annular sides with radially outwardly arranged, rearwardly curved, vanes between the sides. A clearing that corresponds to sides of the casing is located outwardly of the sides. Auxiliary vanes are provided to generate a pressure gradient to prevent or counteract leakage of working fluid. Leading faces of the auxiliary vanes slope relative to and perpendicular to the sides. The leading edges are at an obtuse angle to the sides.

U.S. Patent Application Publication No. 2007/0258824, published on Nov. 8, 2007 to Pacello et al., provides a rotor for viscous or abrasive fluids. This rotor comprises a drive disc and a plurality of driven discs in a stack. The stacked discs are in spaced relationship along a rotational axis so as to form inter-disc spaces. A centrally-positioned aperture is provided in each of the driven discs so as to open into the inter-disc spaces. A hub is connected to the drive disc for communication with a driveshaft. There is a plurality of axial vanes within the apertures and attached to the discs whereby rotation of the rotor causes the fluids to be drawn into the apertures and then into the inter-disc spaces.

U.S. Patent Application Publication No. 2008/0213093, published on Sep. 4, 2008 to J. Guelich, discloses an impeller for pumps in which a rotary wheel includes an intermediate wall at which one or more vanes are provided on each side thereof. Passage openings are formed in the intermediate wall in order to distribute a desired pump flow into the vanes on both sides of the intermediate wall.

U.S. Patent Application Publication No. 2012/0014779, published on Jan. 16, 2012 to C. D. Gillim, teaches a disc pump having one or more rotating discs within a housing. The discs have a plurality of relatively small surface perturbations covering at least one-half of one side of their surface. The perturbations may be recessed or raised. In operation, a boundary layer is formed near the surface of the rotating discs. The fluid within the pump flows in a circular and outward direction, thus moving the fluid from a central coaxial inlet to an outlet located at the peripheral wall of the housing. The surface perturbations produce turbulence within the boundary layer during operation.

U.S. Patent Application Publication No. 2015/0308446, published on Oct. 29, 2015 to Koivikko et al., shows an impeller for a centrifugal pump in which the impeller includes a front shroud, a rear shroud, and one or more working vanes therebetween. The front shroud has a front surface opposite to the face having the working vanes. The rear shroud has a rear face opposite to the face having the working vanes. The front shroud has an outer circumference of the plurality of front pump-out vanes attached to the front face of the front shroud. The rear shroud has a plurality of rear pump-out vanes attached to the rear face of the rear shroud.

International Publication No. WO2014/073976, published on May 15, 2014 to S. Ree, discloses an impeller for a centrifugal pump for pumping drill fluid containing cuttings. The impeller has a rear side wall and a front side wall. Arranged between the rear side wall and the front side wall is a number of vanes with an outer edge and a vane with in the axial direction. At least one of the periphery of the rear side wall or the periphery of the front side wall projects by radial distance beyond the outer edge of the vanes. The radial distance is at least 0.5 times the vane width.

The present Applicant is the owner of U.S. Pat. No. 11,680,578, issued on Jun. 20, 2023 to J. Jimenez. This patent describes an impeller for a disc pump that has a drive disc with a connector for joining to a shaft of the disc pump, a driven disc affixed to the drive disc so as to define a space therebetween, and a plurality of wing vanes formed in the face of the at least one of the drive disc and the driven disc. The drive disc has a face facing a face of the driven disc. The drive disc extends in generally parallel planar relationship to the driven disc. The plurality of wing vanes radiate across the face toward an outer diameter of one of the drive disc and the driven disc. Each of the wing vanes has a portion extending outwardly beyond the outer diameter of the drive disc and the driven disc.

It is an object of the present invention to provide a pump apparatus that pumps shear sensitive fluids.

It is another object to the present invention to provide a pump apparatus that decreases the shear effect.

It is another object of the present invention to provide a pump apparatus that protects the medium.

It is a further object to the present invention to provide a pump apparatus that allows for the injection of a gas into the valute.

It is a further object of the present invention to provide a pump apparatus that has no sharp edges.

It is a further object to the present invention to provide a pump apparatus that efficiently propels fluids.

It is another object of the present invention to provide a pump apparatus that has minimal turbulence and vortices.

It is still another object of the present invention to provide a pump apparatus that allows a gentle force-energy to be transferred to the liquid.

It is another object of the present invention to provide a pump apparatus that has more surface area for more drag/surface tension on the medium.

It is a further object to the present invention to provide a pump apparatus that gently mixes, causes entrainment, and gently mingles the fluids.

These and other objects and advantages of the present invention will become apparent from a reading of the attached specification and appended claims.

SUMMARY OF THE INVENTION

The present invention is an impeller for a disc pump. The impeller includes a drive disc having a connector adapted to join with a shaft of the disc pump and a driven disc affixed to the drive disc so as to define a space therebetween. The drive disc has a face facing the face of the driven disc. The drive disc extends in generally parallel relationship to the driven disc. At least one of the faces of the drive disc and the driven disc as an undulating surface thereon.

The undulating surface has hills and valleys formed with at least one of the faces of the drive disc and the driven disc. In the preferred embodiment of the present invention, each of the faces of the drive disc and the driven disc has the undulating surface thereon. The hills and valleys of one of the drive disc and the driven disc correspond to the location to the hills and valleys of another of the drive disc in the driven disc such that the space between the face of the drive disc and face of the driven disc widens and narrows around an inner diameter of the drive disc and the driven disc.

At least one post is affixed to the face of the drive disc and the face of the driven disc. This post is positioned inwardly of an outer diameter of the drive disc and the driven disc. The post has an airfoil-shaped cross-section in a plane parallel to the faces of the drive disc and the driven disc. The airfoil-shaped cross-section post has a narrow end and a wide end. The wide end faces the direction of fluid flow in the impeller. The at least one post comprises a plurality of post positioned in evenly spaced relationship in the space between the drive disc and the driven disc. Each of the plurality of posts has the airfoil-shaped cross-section. The wide end of one of the plurality of posts faces the narrow end of an adjacent post of the plurality of posts. A longitudinal axis of the airfoil-shaped cross-section post extends at an angle of between 0° and 20° with respect to a diameter of the drive disc and the driven disc.

We live in a world where more and more of the liquids used in power processes are recycled and reused. The discarding of expensive polymers or utilizing inefficient processes is not affordable. The present invention provides a disc pump with disc design improvements that have no sharp edges and which incorporate airfoil designs for the post.

The wavy undulating disc design extends from the center of the disc and extends to the periphery. This efficiently propels the fluids without sharp edges in order to shear or cause turbulence/vortices. Friction drag and surface tension is still used to propel the medium.

The undulating wave-like design on the disc faces allows for a gentle force-energy to be transferred to the liquid. Also, the hills and valleys create more surface area which, in turn, creates more friction drag/surface tension to act on the medium. The posts between the discs each has an airfoil design to impart energy on the medium in a manner similar to that of an airplane wing. The top of the wing will have high-speed low-pressure while the bottom of the wing will have high-pressure and will propel the medium to the periphery to the discharge nozzle. This airfoil design can have ailerons with different angles of attack adding additional pressure depending on the fluids being moved.

There are many processes where it is advantageous to inject a polymer/surfactant and/or air/gas into the pumping cavity while bypassing the suction of the pump in order to avoid the suction turbulence and shearing. The present invention gently mixes, causes entrainment and a gentle mingles the fluid. The present invention utilizes an injecting loop around the casing with self-atomizing injectors.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
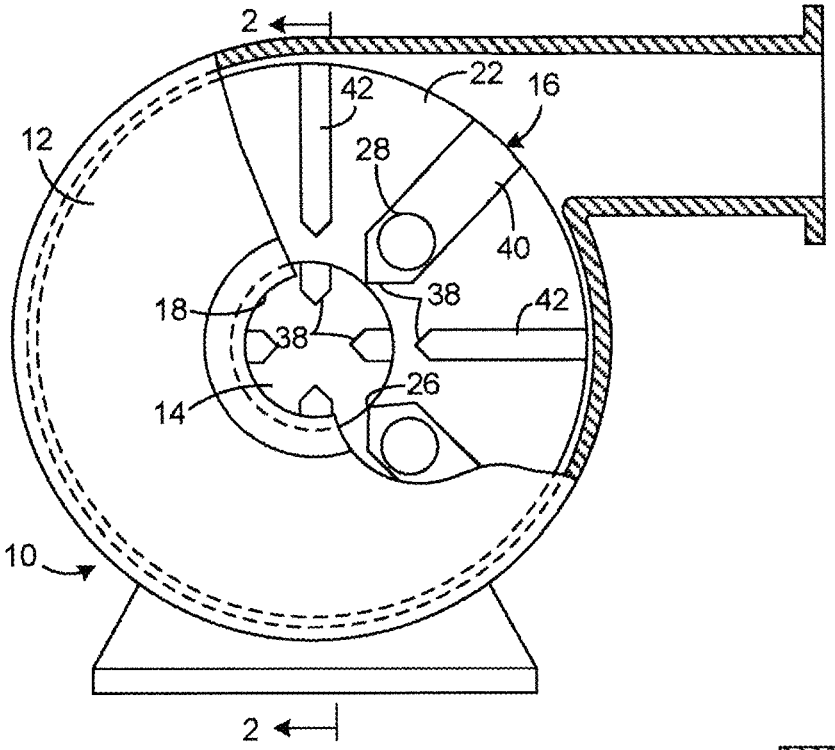
FIG. 1 PRIOR ART
FIG. 1 is a side cross-sectional view showing a disc pump of the prior art.
Figure 2:
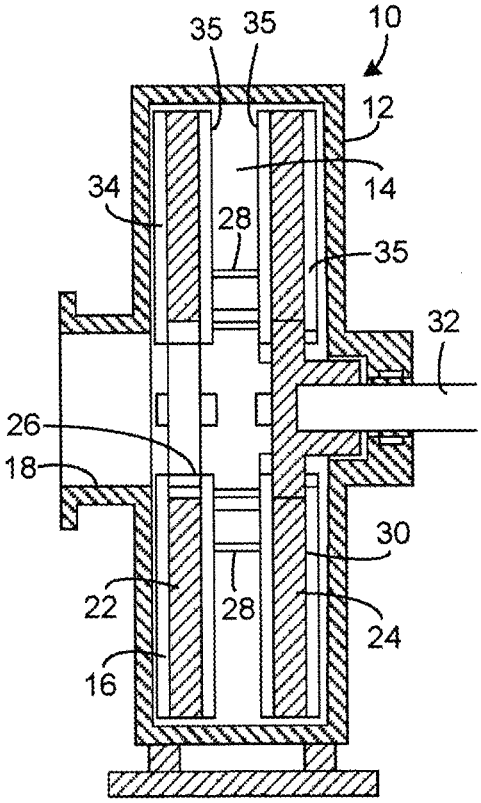
FIG. 2 PRIOR ART
FIG. 2 is a cross-sectional view taken across lines 2-2 of FIG. 1 of the disc pump of the prior art.
Figure 3:
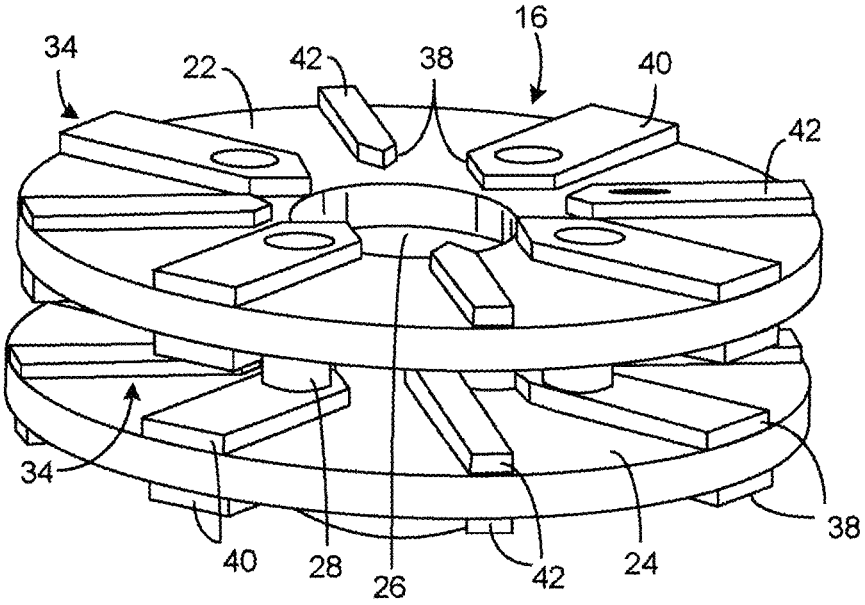
FIG. 3 PRIOR ART
FIG. 3 is an upper perspective view of the impeller as used in the disc pump of the prior art.
Figure 4:
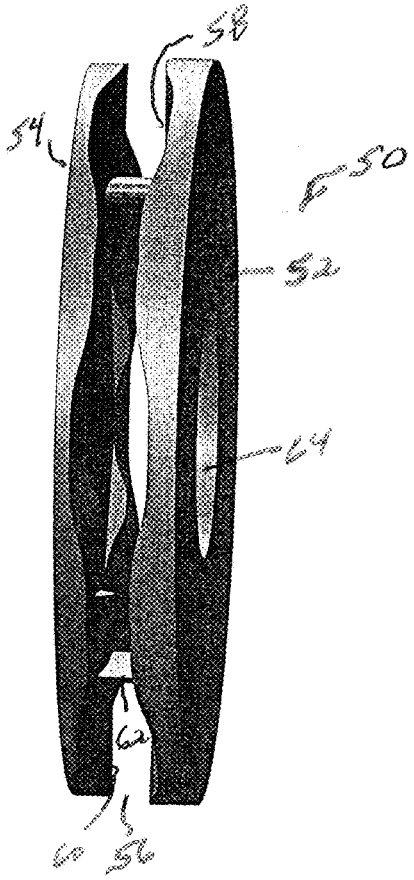
FIG. 4 is a side perspective view of the impeller as used in the disc pump of the present invention.

Referring to FIG. 4, there is shown the impeller the impeller 50 for the disc pump. The disc pump is of a type shown in FIGS. 1-3 hereinbefore. The impeller 50 is to be used in place of the impeller 16 described in association with FIGS. 1-3.

The impeller 50 includes a drive disc 54 having a connector adapted to join with a shaft of a disc pump. A driven disc 52 is affixed to the drive disc 54 so as to define a space 56 therebetween. The drive disc 54 has a face 60 facing a face 58 of the driven disc 52. As can be seen, the drive disc 54 extends in generally parallel relationship to the driven disc 52. It can be seen that the drive disc 54 has an undulating surface on the face 60. Similarly, the driven disc 52 has an undulating surface on the face 60 thereof.

In FIG. 4, it can be further seen that there are a plurality of posts 62 that extend between the drive disc 54 and the driven disc 52 located in the space 56. Each of the posts 62 has a special airfoil-shaped cross-section (as will be described hereinafter). The drive disc 54 includes a central opening 64 which allows fluids to be introduced into the space 56 between the drive disc 54 and the driven disc 52. The rotation of the impeller 50 will cause the fluid introduced through the opening 62 to gently mix in the space 56 and be propelled ultimately out of the disc pump (in the manner described hereinbefore in association with FIGS. 1-3).

Figure 5:
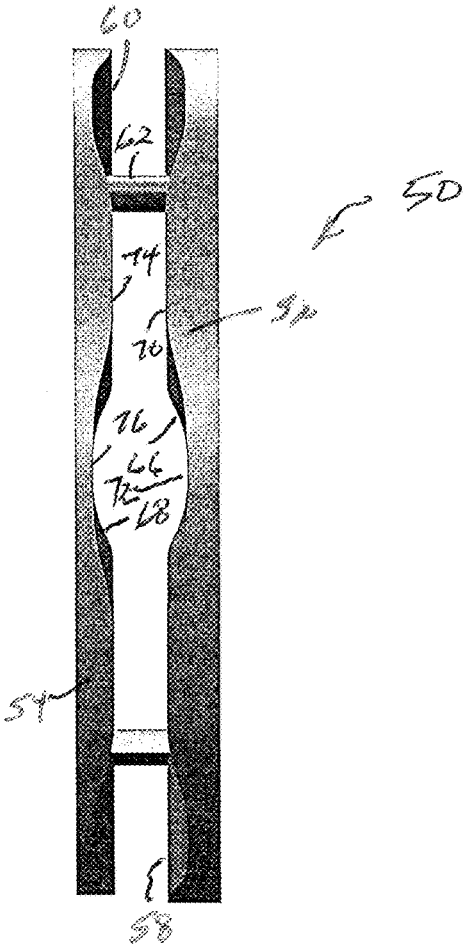
FIG. 5 is a side elevational view of the impeller as used in the disc pump of the present invention.

FIG. 5 particularly illustrates the undulating surface 66 of the drive disc 54 and the undulating surface 68 of the driven disc 52. In particular, the undulating surface 66 includes hills 70 and valleys 72. Similarly, the undulating surface 68 of the driven disc 52 includes hills 74 and valleys 76. In FIG. 5, it can be seen that the hills 70 and valleys 72 of the drive disc 54 correspond in location to the hills 74 and valleys 76 of the driven disc 52 around the inner diameter of the drive disc 54 and the driven disc 52. These undulating surfaces are repeated along the faces 60 and 58 of the respective drive disc 54 and the driven disc 52. Posts 62 are illustrated as positioned as affixed to the face 60 of the drive disc 54 and to the face 58 of the driven disc 54.

Figure 6:
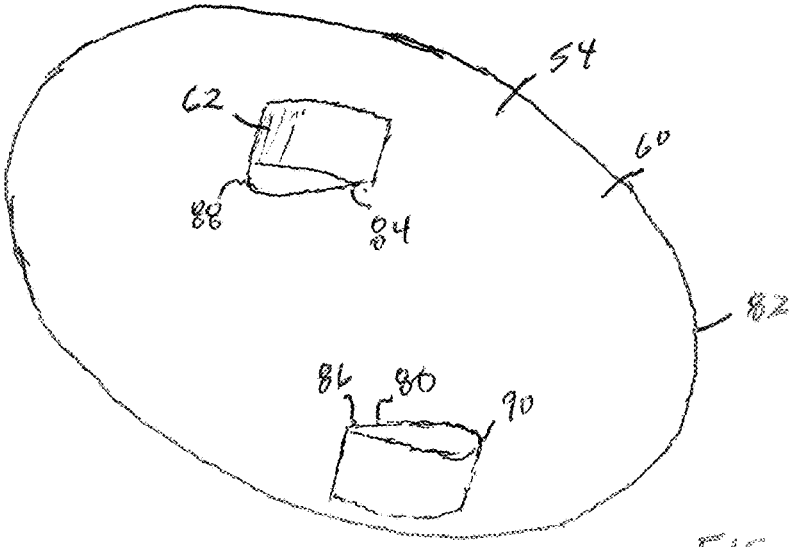
FIG. 6 is an upper perspective view of the drive disc as used in the impeller of the disc pump of the present invention.
Figure 7:
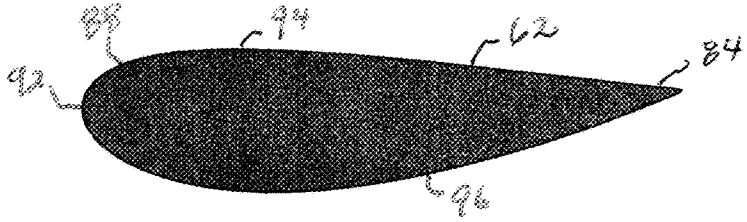
FIG. 7 is a cross-sectional view of the post as used between the discs of the disc pump of the present invention.

FIG. 6 is a perspective view illustrating the construction of the face 60 of the drive disc 54. The undulating surface is particularly omitted in FIG. 6. FIG. 6 further shows the configuration of the post 62 and the post 80.

FIG. 6 shows that the posts 62 and 80 are positioned inwardly of the outer diameter 82 of the drive disc 54. Each of the posts 62 and 80 has an airfoil-shaped cross-section in a plane parallel to the face 58 of the drive disc 54. It can be seen that this airfoil-shaped cross-section section of the posts 62 and 80 have respective a narrow end 84 and 86 and an respective wide end 88 and 90. The wide ends 88 and 90 will face the direction of fluid flow within the impeller 50. Each of the posts 62 and 80 has the airfoil-shaped cross-section. The wide end 88 of the post 62 will face the narrow end 86 of the adjacent post 80. Similarly, the wide end 90 of the post 80 will face the narrow end 84 of the adjacent post 62.

FIGS. 4-6 show that the posts 62 are only two in number. Within the concept of the present invention, a various numbers of posts can be included within the space 56 between the drive disc 54 and the driven disc 52, depending upon the requirements of the system, the speed of the impeller, the materials being processed, the strength of the discs, and various other factors. Also, with reference to FIG. 6, it should be noted that the posts 62 and 80 are joined to the face 60 of the driven disc 54 in a similar manner.

FIG. 8 shows the airfoil-shaped cross-section post 62. Post 62 includes a curved end 92 at the wide end 88. The surface 94 forms a continuous curve toward the narrow end 84. Similarly, the surface 96 forms a continuous curve from the end 92 from the wide end 88 to the narrow end 84 in the shape of an airfoil.

Figure 8B:
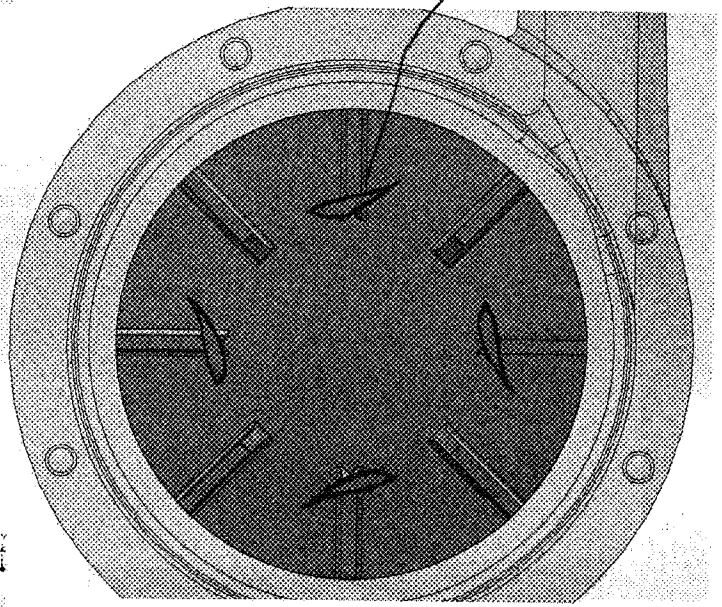
FIGS. 8*a* and 8*b* are plan views showing the varying angles of attach of the posts as used in the disc pump of the present invention.
Figure 8A:
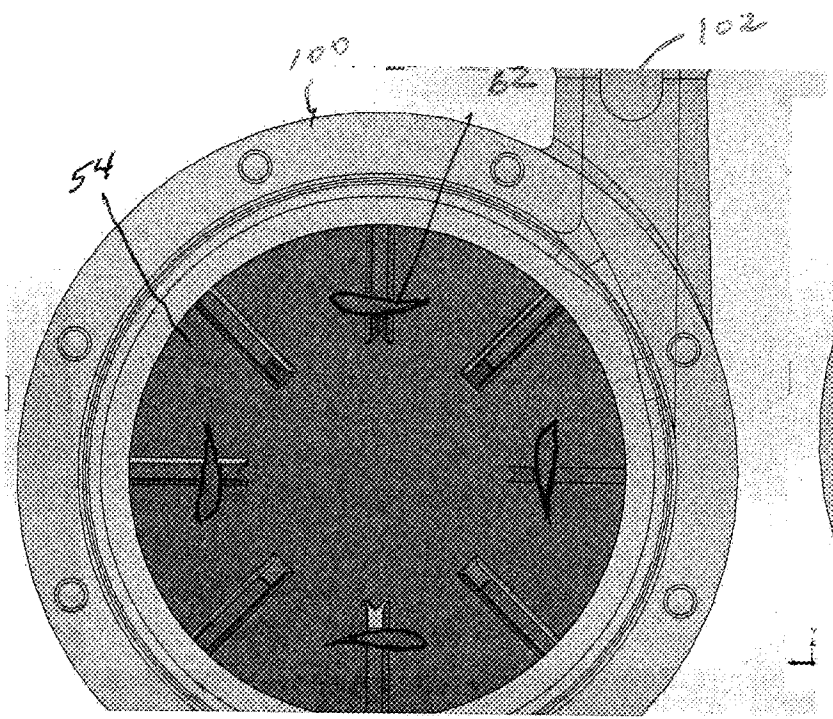

FIGS. 8*a* and 8*b* show the positioning and arrangement of the various posts 62 on the interior of the disc pump 100. The posts 62 are illustrated as positioned on the undulating surface of the drive disc 54. In particular, as can be seen in FIGS. 8*a* and 8*b*, the longitudinal axis of the airfoil-shaped cross-section posts 62 extends at an angle of between 0° and 20° with respect to a diameter of the discs. FIG. 8*a* shows the airfoil-shaped cross-section post 62 extending at a 0° angle. FIG. 8 shows the posts 62 as extending at a 20° angle. As such, the angle of the airfoil-shaped posts 62 can be configured based upon the types of fluids to be processed, the rate of pumping, and over a wide variety of other factors.

The undulating wave design on the faces of the discs allows for a gentle force-energy to be transferred to the liquid. The hills and valleys create more surface area which, in turn, creates more friction drag/surface tension to act on the medium. The undulating surface will extend from the center of the disc to the periphery of the disc. This efficiently propels the fluids without using any sharp edges that could cause shear or cause turbulence/vortices. Friction drag and surface tension are still used to propel the medium.

The posts 62 between the discs have an airfoil cross-section configuration in order to impart energy on the medium in a manner similar to that of an airplane wing. The top of the wing will have high-speed low-pressure while the bottom of the wing will have high-pressure. This will propel the medium to the periphery to the discharge nozzle 102. This airfoil design can have ailerons in different angles of attack (such as shown in FIGS. 8*a* and 8*b*) in order to add additional pressure (depending on the fluid being moved).

There many processes where it is advantageous to inject a polymer/surfactant and/or air/gas into the pumping cavity bypassing the suction of the pump in order to avoid the suction turbulence and shearing. This is to gently mix, cause entrainment and a gentle mingling of the fluid. In the present invention, there is an injecting loop around the casing with self-atomizing injectors.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. An impeller for a disc pump, the impeller comprising:

a drive disc having a connector adapted to join with a shaft of the disc pump;

a driven disc affixed to said drive disc so as to define a space therebetween, said drive disc having a face facing a face of said driven disc, said drive disc extending in parallel relationship to said driven disc, wherein at least one of the faces of said drive disc and said driven disc has an undulating surface thereon; and a plurality of posts affixed to the face of said drive disc and the face of said driven disc so as to extend therebetween, wherein each of said plurality of posts has an airfoil-shaped cross-section in a plane parallel to the face of said drive disc and the face of said driven disc, wherein the airfoil-shaped cross-section has a narrow end and a wide end, the wide end facing a direction of fluid flow in the impeller, the wide end of said plurality of posts respectively facing the narrow end of an adjacent post of said plurality of posts, the airfoil-shaped cross-section being rounded at the wide end and having a convex inner surface extending between the wide end and the narrow end.

2. The impeller of claim 1, wherein the undulating surface has hills and valleys formed in the at least one of the faces of said drive disc and said driven disc.

3. The impeller of claim 2, wherein each of the faces of said drive disc and said driven disc has the undulating surface thereon.

4. The impeller of claim 3, wherein the hills and valleys of one of said drive disc and said driven disc correspond in location to the hills and valleys of another of said drive disc and said driven disc such that the space between the face of said drive disc and the face of said driven disc widens and narrows around an inner diameter of said drive disc and said driven disc.

5. The impeller of claim 1, wherein said at least one post is positioned inwardly of an outer diameter of said drive disc and said driven disc.

6. The impeller of claim 1, said plurality of posts are positioned in an evenly spaced relation in the space between said drive disc and said driven disc.

7. The impeller of claim 1, wherein a longitudinal axis of the airfoil-shaped cross-section extends at an angle of between 0° and 20° with respect to a diameter of one of said drive disc and said driven disc.

* * * * *